United States Patent [19]

Okabe et al.

[11] Patent Number: 4,528,892

[45] Date of Patent: Jul. 16, 1985

[54] HYDRAULIC CIRCUIT SYSTEM FOR CONSTRUCTION MACHINE

[75] Inventors: Nobuya Okabe, Tsuchiura; Hiroshi Mizushima, Ibaraki, both of Japan

[73] Assignee: Hitachi Construction Machinery Co., Ltd., Tokyo, Japan

[21] Appl. No.: 469,403

[22] Filed: Feb. 24, 1983

[30] Foreign Application Priority Data

Feb. 25, 1982 [JP] Japan ..... 57-28074

[51] Int. Cl.[3] ..... F15B 11/16; F15B 13/06

[52] U.S. Cl. ..... 91/6; 91/520; 91/527; 91/531; 414/699

[58] Field of Search ..... 91/518, 520, 527, 530, 91/531, 6; 60/484, 486; 414/699

[56] References Cited

U.S. PATENT DOCUMENTS

| | | | |
|---|---|---|---|
| 3,922,855 | 12/1975 | Bridwell et al. | 60/484 |
| 4,112,821 | 9/1978 | Bianchetta | 60/486 |
| 4,142,445 | 3/1979 | Lohbauer | 91/6 |
| 4,210,061 | 7/1980 | Bianchetta | 91/531 |

*Primary Examiner*—Irwin C. Cohen

*Attorney, Agent, or Firm*—Antonelli, Terry & Wands

[57] ABSTRACT

A hydraulic circuit system of a construction machine having first and second hydraulic circuit, and a bypass circuit for connecting the first and second circuits together. The first circuit includes a first hydraulic pump and a first valve group having a plurality of directional control valves for controlling a flow of hydraulic fluid from the first pump, and the second circuit includes a second hydraulic pump and a second valve group having a plurality of directional control valves for controlling a flow of hydraulic fluid from the second pump. A plurality of actuators are driven by the hydraulic fluid supplied from the first and second pumps through the valves. The bypass circuit includes a bypass line for connecting the first travel valve in series with the second travel valve in a position downstream thereof through the selecting valve. The selecting valve has first and second positions and is normally in the first position to communicate the second travel valve with the other valves of the second group to supply the hydraulic fluid from the second travel valve to the other valves. When the first travel valve and at least one of the other valves of the second group are simultaneously actuated, the selecting valve is switched to the second position to bring the second travel valve into communication with the first travel valve through the bypass line thereby to supply the hydraulic fluid from the second travel valve to the first travel valve.

11 Claims, 4 Drawing Figures

HYDRAULIC CIRCUIT SYSTEM FOR CONSTRUCTION MACHINE

BACKGROUND OF THE INVENTION

This invention relates to hydraulic circuit systems for construction machines, and more particularly to a hydraulic circuit system for a construction machine such as a hydraulic excavator which is equipped with a plurality of working elements.

Generally, a hydraulic excavator is equipped with a plurality of working elements including a swing, left and right travelling tracks, a boom, an arm and a bucket. These working elements are driven by hydraulic actuators such as a swing motor, a pair of travel motors, a boom cylinder, an arm cylinder and a bucket cylinder which are incorporated in a hydraulic circuit system.

Typically, the hydraulic circuit system has been constructed such that the hydraulic actuators are classified into two groups and each group is provided with a separate hydraulic pump to constitute a first hydraulic circuit and a second hydraulic circuit, and the actuators of each hydraulic circuit are connected in parallel with one another through respective directional control valves. The hydraulic circuit system of this construction offers the advantages that the construction of the hydraulic circuits is simple and that a plurality of actuators can be simultaneously driven. However, disadvantages are associated with this system. More particularly, when combined operations are performed for simultaneously driving a plurality of actuators, movements of the actuators connected in parallel with each other might be influenced by the working pressures of the respective actuators and actuators of higher working pressures might have their working speeds reduced or might be rendered inoperative because of the hydraulic fluid flowing into actuators of lower working pressures.

To obviate such problems, a proposal has been made in U.S. Pat. No. 4,112,821 to connect in tandem a plurality of directional control valves in each hydraulic circuit to ensure that each actuator operates independently of other actuators. More specifically, the hydraulic circuit system disclosed in this U.S. patent comprises first and second hydraulic circuit means, and the first hydraulic circuit means has a swing directional control valve, a left travel directional control valve and an arm directional control valve which are connected in tandem with one another in the indicated order with respect to a first hydraulic pump to constitute a first valve group, while the second hydraulic circuit means has a right travel directional control valve, a bucket directional control valve and a boom directional control valve which are connected in tandem with one another with respect to a second hydraulic pump in the indicated order to constitute a second valve group. Center bypass lines of the first and second valve groups are connected to a reservoir and each have an on-off valve mounted therein. A plurality of bypass circuits are formed between predetermined positions in the first and second hydraulic circuit means in order to avoid the defects which the system might suffer on account of the tandem connections for ensuring independent operations of the swing motor, left travel motor, arm cylinder, right travel motor, bucket cylinder and boom cylinder.

Thus, in the hydraulic circuit system of the aforesaid construction, the swing can operate completely independently of the boom and bucket and can operate independently to a certain degree with respect to the arm due to the provision of a flow restrictor in the associated bypass circuit. Also, by virtue of the action of other bypass circuits, it is possible to perform combined operations of two actuators in the same hydraulic circuit means such as operation of the arm cylinder while operating the swing motor, and to perform combined operations of three actuators, such as operation of the swing motor while operating the left and right travel motors.

Thus, the hydraulic circuit system disclosed in the above noted U.S. patent referred has succeeded to a certain extent in accomplishing the object of performing combined operations of a plurality of actuators while ensuring that the actuators operate independently of one another. However, this system is faced with the problem that, since the directional control valves for the actuators are essentially connected in tandem with one another, limits are placed on the range of combined operations of the actuators and the operability of the system would not be so high. For example, since the boom directional control valve and the bucket directional control valve are connected in tandem with the right travel directional control valve at a location downstream thereof, a boom raising operation or a bucket raising operation can not be performed while travelling is performed. Also, although the arm operation during travelling can be performed by the action of the bypass circuit, it would be impossible to perform an arm operation satisfactorily when the working pressure of the right travel motor is low since hydraulic fluid from the first pump would flow into the left travel motor. It would be impossible to steer the vehicle by operating the left travel motor during swing operation, since the on-off valve mounted in the center bypass line of the second valve group is held in an open position to allow hydraulic fluid from the second pump to directly flow into the reservoir and keep hydraulic fluid from being supplied to the left travel motor.

SUMMARY OF THE INVENTION

An object of this invention is to provide a hydraulic circuit system for a construction machine in which during travelling, any one of the other actuators can be operated simultaneously.

Another object is to provide a hydraulic circuit system for a construction machine in which during travelling, any one of the other actuators can be operated independently of the travelling operation.

Still another object is to provide a hydraulic circuit system for a construction machine in which steering either in the right or left direction can be freely conducted when any one of the actuators is operated during travelling.

A further object is to provide a hydraulic circuit system for a construction machine in which combined operations of actuators in a wide range can be performed while substantially ensuring independency of an operation of each actuator.

According to the invention, a hydraulic circuit system for a construction machine is provided which includes first hydraulic circuit means, second hydraulic circuit means and bypass circuit means connecting the first and second hydraulic circuit means together, the first hydraulic circuit means including a first hydraulic pump and a first valve group having a plurality of directional control valves for controlling a flow of hydraulic fluid from the first hydraulic pump, and the second hydraulic circuit means including a second hydraulic pump and a second valve group having a plurality of directional control valves for controlling a flow of hydraulic fluid from said second hydraulic pump, a plurality of actuators being driven by the hydraulic fluid supplied from the first and second hydraulic pumps through the directional control valves of the first and second valve groups, wherein the directional control valves of the first valve group in the first hydraulic circuit means include a first travel directional control valve for controlling a first travel actuator, the first travel directional control valve being connected in tandem with other valves of the first valve group in a position downstream thereof so that the other directional control valves of the first valve group can take priority in receiving a supply of hydraulic fluid from said first hydraulic pump. The directional control valves of said second valve group in the second hydraulic circuit means include a second travel directional control valve for controlling a second travel actuator, the second travel directional control valve being connected in series with other valves of the second valve group in a position upstream thereof through a directional selecting valve so that the second travel directional control valve can directly receive a supply of hydraulic fluid from the second hydraulic pump to supply the same to said second travel actuator and returns hydraulic fluid from the second travel actuator to the second hydraulic circuit means. The bypass circuit means includes a first bypass line for connecting said first travel directional control valve in series with said second travel directional control valve in a position downstream thereof through the directional selecting valve, and the directional selecting valve has first and second positions, with the directional selecting valve normally taking the first position to communicate the second travel directional control valve with the other valves of the second valve group to supply hydraulic fluid from the second travel directional control valve to the other valves. The directional selecting valve being switched to the second position when the first travel directional control valve and at least one of the other valves of the second valve group are simultaneously actuated to bring the second travel directional control valve into communication with the first travel directional control valve through the first bypass line to thereby supply hydraulic fluid from the second travel directional control valve to the first travel directional control valve.

DESCRIPTION OF THE PREFERRED EMBODIMENTS

Figure 1:
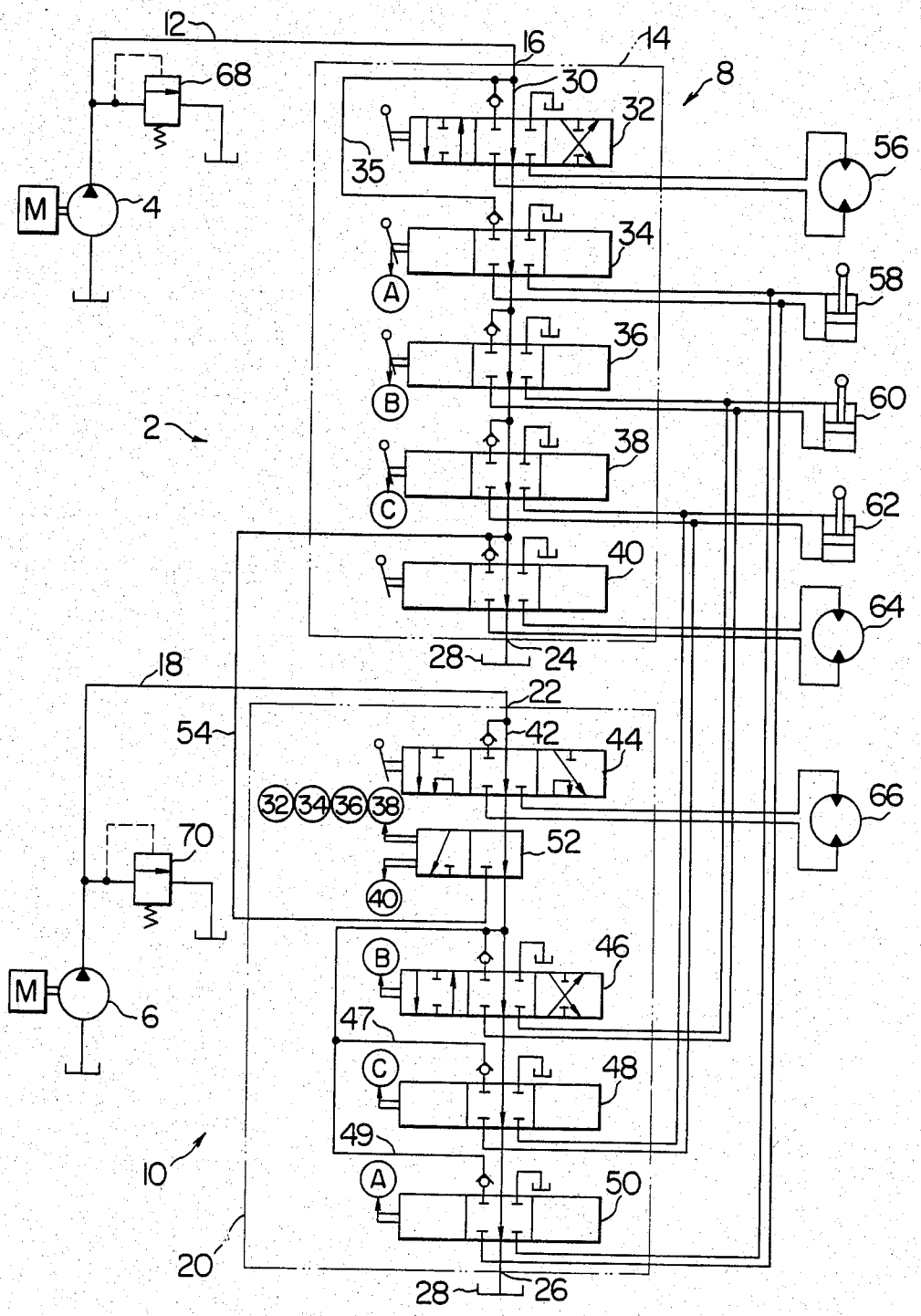
FIG. 1 is a circuit diagram of the hydraulic circuit system comprising a first embodiment of the invention.

Referring now to the drawings wherein like reference numerals are used throughout the various views to designate like parts and, more particularly, to FIG. 1, according to this figure, a hydraulic circuit system generally designated by the reference numeral 2 for a construction machine comprises a first hyraulic circuit generally designated by the reference numeral 8 and a second hydraulic circuit generally designated by the reference numeral 10 having a first hydraulic pump 4 and a second hydraulic pump 6, respectively. The first hydraulic pump 4 and the second hydraulic pump 6 are driven by a common prime mover M. In the first hydraulic circuit 8, the first pump 4 is connected to a common pump port 16 of a first valve group 14 through a main line 12. In the second hydraulic circuit 10, the second pump 6 is connected to a common pump port 22 of a second valve group 20 through another main line 18. Common reservoir ports 24 and 26 of the valve groups 14 and 20 are connected to a reservoir 28.

The first valve group 14 has a swing directional control valve 32, a first boom directional control valve 34, a first arm directional control valve 36, a first bucket directional control valve 38 and a left travel directional control valve 40 which are connected with one another in the indicated order from the upstream side of a center bypass line 30 to the downstream side thereof. The swing valve 32 and the first boom valve 34 are connected in parallel with each other through a bypass line 35, and these valves 32 and 34 and the first arm valve 36, first bucket valve 38 and left travel valve 40 are connected in tandem with each other.

The second valve group 20 has a right travel directional control valve 44, a second arm directional control valve 46, a second bucket directional control valve 48 and a second boom directional control valve 50 which are connected with each other in the indicated order from the upstream side of a center bypass line 42 to the downstream side thereof. The second arm valve 46, second bucket valve 48 and second boom valve 50 are connected in parallel with one another thorough bypass lines 47 and 49. The right travel valve 44 is constructed to return used hydraulic fluid to the center bypass line 42 and connected in series with the valves 46, 48 and 50 in a position upstream thereof.

A directional selecting valve 52 is mounted between the right travel valve 44 and the second arm valve 46 and connected through a bypass line 54 to the center bypass line 30 of the first valve group 14 in a position upstream of the first travel valve 40. The directional selecting valve 52 is normally disposed in a first position shown in FIG. 1 in which it allows hydraulic fluid to flow through the center bypass line 42 to the downstream side. When the left travel valve 40 and at least one of the swing valve 32, boom valve 34, arm valve 36 and bucket valve 38 are simultaneously actuated, the directional selecting valve 52 is switched to a second position in which it allows the center bypass line 42 to communicate, through the bypass line 54 in a position immediately downstream of the right travel valve 44, with the center bypass line 30 in a position immediately upstream of the left travel valve 40. Thus, the right and left travel valves 44 and 40 are connected in series with each other.

Figure 2:
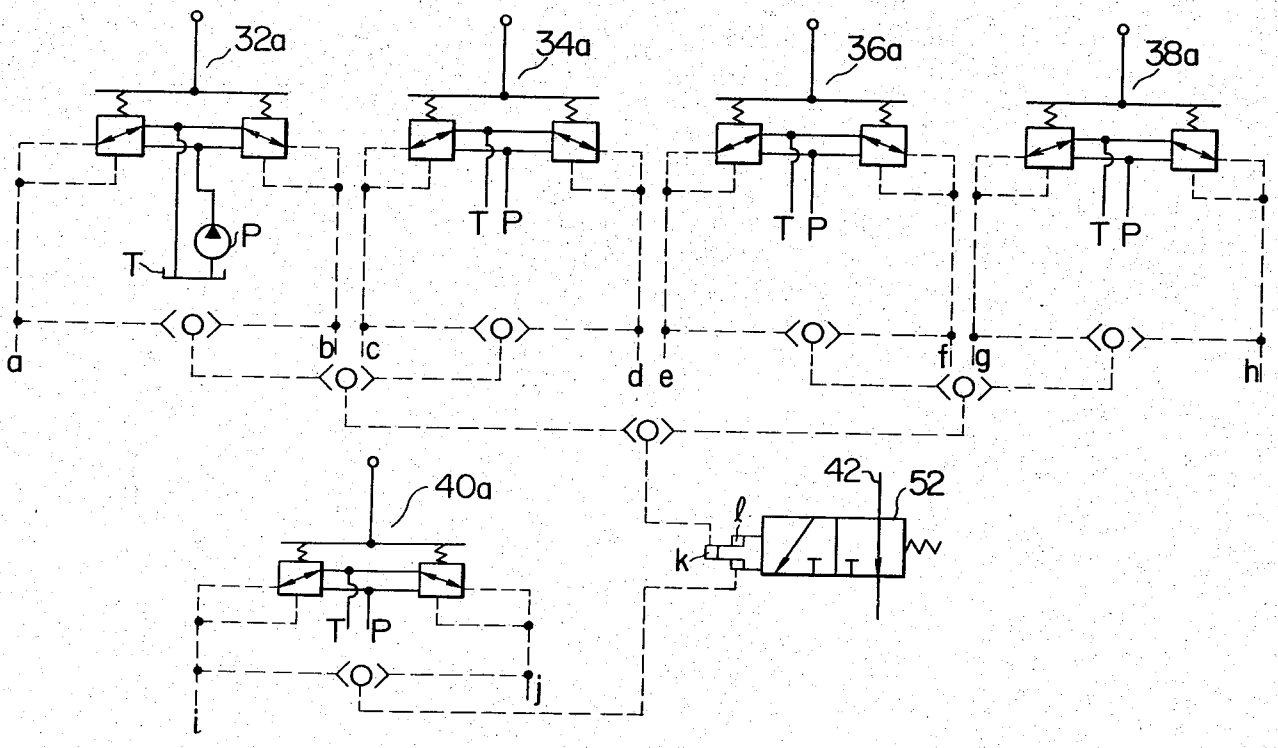
FIG. 2 is a circuit diagram showing operation means for the directional selecting valve of the hydraulic circuit system shown in FIG. 1.

Operation means for the directional selecting valve 52 may be constructed as shown in FIG. 2, for example. In this example, the directional control valves are of the hydraulically operated type. Pilot operation valves 32*a*, 34*a*, 36*a* and 38*a* for the directional control valves 32, 34, 36 and 38 are operative to produce, when they are actuated by manipulating respective operation levers, pilot pressures a or b, d or c, e or f and g or h, respectively, by a pilot pump P depending on the direction of operation. These pilot pressures are selected by shuttle valves and led to a pilot chamber k of the directional selecting valve 52. When a pilot operation valve 40*a* for the right travel valve 40 is actuated by manipulating an operation lever thereof, a pilot pressure i or j is produced depending on the direction of operation and led to a pilot chamber l of the directional selecting valve 52. The directional selecting valve 52 has a biasing force of a spring set in such a manner that it is switched from first position to the second position only when hydraulic pressures are introduced into both of the two pilot chambers k and l. Thus, the valve 52 is normally in the first position shown, and switched to the second position when valve 40 and at least one of the valves 32, 34, 36 and 38 are actuated at the same time.

The operation means for the directional selecting valve 52 is not limited to the aforesaid hydraulically operated type, and any other suitable operation means, such as of a mechanically operated type, electrically operated type, may be used.

Referring to FIG. 1 again, the swing valve 32, boom valves 34 and 50, arm valves 36 and 46, bucket valves 38 and 48, left travel valve 40 and right travel valve 44 are connected to a swing motor 56, a boom cylinder 58, an arm cylinder 60, a bucket cylinder 62, a left travel motor 64 and a right travel motor 66, respectively. The boom valves 34 and 50, arm valves 36 and 46 and bucket valves 38 and 48 are linked to each other by linking means A, B and C, respectively. The linking means A, B and C may be of a hydraulically operated type, mechanically operated type or electrically operated type. 68 and 70 are relief valves.

Operation of the valves will now be described.

(1) Travelling Operation

Hydraulic fluid from the first hydraulic pump 4 is supplied to the left travel motor 64 through the left travel valve 40, and hydraulic fluid from the second hydraulic pump 6 is supplied to the right travel motor 66 through the right travel valve 44. Thus, the left and right travel motors 64 and 66 can be actuated independently of each other.

(2) Travelling Operation Combined with Operation of One of Other Actuators

Assume that travelling operation combined with swing operation which is one of swing, boom, arm and bucket operations are performed. Hydraulic fluid from the first hydraulic pump 4 is supplied to the swing motor 56. The directional selecting valve 52 is switched from the first position to the second position as the swing valve 32 and left travel valve 40 are simultaneously actuated, so that the right travel valve 44 and left travel valve 40 are connected in series with each other through the bypass line 54. This causes hydraulic fluid from the second hydraulic pump 6 to be supplied to the right travel motor 66 through the right travel valve 44 while used fluid from the right travel motor 66 is returned to the center bypass line 42 and flows through the directional selecting valve 52 and bypass line 54 and is then supplied to the left travel motor 64 throught the left travel valve 40. Thus, the swing motor 56 and the left and right travel motors 64 and 66 are actuated simultaneously and independently.

When the vehicle is steered in the right direction during a swing operation, hydraulic fluid from the first pump 4 is supplied to the swing motor 56 and no hydraulic fluid from the second pump 6 is supplied to the right travel motor 66 since the right travel valve 44 is returned to a neutral position, and the hydraulic fluid from the second pump 6 is supplied to the left travel motor 64 through a center bypass port of the right travel valve 44, directional selecting valve 52 in the second position and bypass line 54 and through the left travel valve 40. When the vehicle is steered in the left direction during a swing operation, hydraulic fluid from the second motor 6 is supplied to the right travel motor 66 through the right travel valve 44. At this time, the left travel valve 40 is returned to a neutral position, so that the directional selecting valve 52 is in the first position and consequently used fluid from the right travel motor 66 is kept from flowing to the bypass line 54. When the vehicle is steered rapidly in the right or left direction, the end can be attained as desired. Assume that the vehicle is rapidly steered in the right direction. In this case, hydraulic fluid from the second pump 6 is supplied to the right travel motor 66 through the right travel valve 44 in a reverse flow position to drive the motor 66 in a reverse direction and used fluid from the right travel motor 66 is supplied to the left travel motor 64 through the left travel valve 40 to drive the motor 54 in a normal or advancing direction.

Travelling operation combined with boom, arm or bucket operation can be performed in the same manner as described hereinabove by referring to the travelling operation combined with the swing operation. Stated differently, one of boom, arm and bucket operations can be performed simultaneously as travelling independently of each other, and the vehicle can be freely steered in the right or left direction during operation of one of these actuators. At this time, although one of the second arm valve 46, second bucket valve 48 and second boom valve 50 is switched to an operative position, no hydraulic fluid from the second pump 6 is supplied to the valves 46, 48 or 50 except when the vehicle is steered in the left direction, so that the left travel motor 64 performs no function.

(3) Travelling Operation Combined with Swing and Boom Operations

When travelling operation combined with swing and boom operations is performed, hydraulic fluid from the first pump 4 is supplied to the swing motor 56 through the swing valve 32 and at the same time to the boom cylinder 58 through the bypass line 35 and through the first boom valve 34. The directional selecting valve 52 is switched to the second position as the swing valve 32, first boom valve 34 and left travel valve 40 are simultaneously actuated, so that the left and right travel valves 40 and 44 are connected in series with each other through the bypass line 54. This causes hydraulic fluid from the second pump 6 to be supplied to the right travel motor 66 through the right travel valve 44 and allows used fluid from the right travel motor 66 to be returned to the center bypass line 42 and flow through the directional selecting valve 52 and bypass line 54 and through the left travel valve 40 to the left travel motor 64. Thus, the travelling operation and the swing and boom operations can be performed simultaneously and independently.

(4) Swing Operation Combined with Boom, Arm or Bucket Operation

When swing operation combined with boom operation is performed, hydraulic fluid from the first pump 4 is supplied to the swing motor 56 through the swing valve 32 and at the same time to the boom cylinder 58 through the bypass line 35 and through the first boom valve 34. Hydraulic fluid from the second pump 6 is supplied to the boom cylinder 58 through the second boom valve 50. Thus, the swing motor 56 is accelerated by the working pressure of the boom cylinder 58 in such a manner that the swing motor 56 receives only the hydraulic fluid that is necessary for acceleration and excess fluid is fed to the boom cylinder 58. Therefore, the relief valve 68 is not opened while the swing operation is being accelerated. In this case, the swing operation and boom operation are not totally independent of each other, but no loss of pressure is involved, so that the combined operations can be performed efficiently and the boom can be raised to a sufficiently high elevation.

When independence of swing and boom operations of each other is important, one has only to manipulate the boom operation lever in two stages so that the second boom valve 50 will be actuated in the first stage and the first boom valve 34 will be actuated in the second stage. Thus, by manipulating the boom operation lever halfway, the boom cylinder 58 can be operated only with the hydraulic fluid supplied from the second pump 6 through the second boom valve 50 while the swing motor 56 is driven with the hydraulic fluid from the first pump 4, and therefore they can be operated independently of each other.

When swing operation combined with arm operation is performed, the swing valve 32 is actuated to supply hydraulic fluid from the first pump 4 to the swing motor 56 by taking priority. The first arm valve 36 is switched but remains inoperative since no hydraulic fluid from the first pump 4 is supplied thereto. Hydraulic fluid from the second pump 6 is supplied to the arm cylinder 60 through the second arm valve 46, thereby making it possible for the swing and arm operations to be performed simultaneously and independently of each other. When swing operation combined with bucket operation is performed, they can be operated simultaneously and independently in like manner.

(5) Combined Operations of Swing, Boom, Arm and Bucket or Three of These

When boom, arm and bucket operations are performed while operation of the swing is being performed, hydraulic fluid from the first pump 4 is supplied to the swing motor 56 through the swing valve 32 and at the same time to the boom cylinder 58 through the bypass line 35 and through the first boom valve 34. Hydraulic fluid from the second pump 6 is supplied to the arm cylinder 60, bucket cylinder 62 and boom cylinder 58 through the bypass lines 47 and 49 and through the second arm valve 46, second bucket valve 48 and second boom valve 50, thereby enabling the four operations of swing, boom, arm and bucket to be performed simultaneously. It will be appreciated that any three of the four operations described hereinabove also can be performed simultaneously in like manner.

Figure 3:
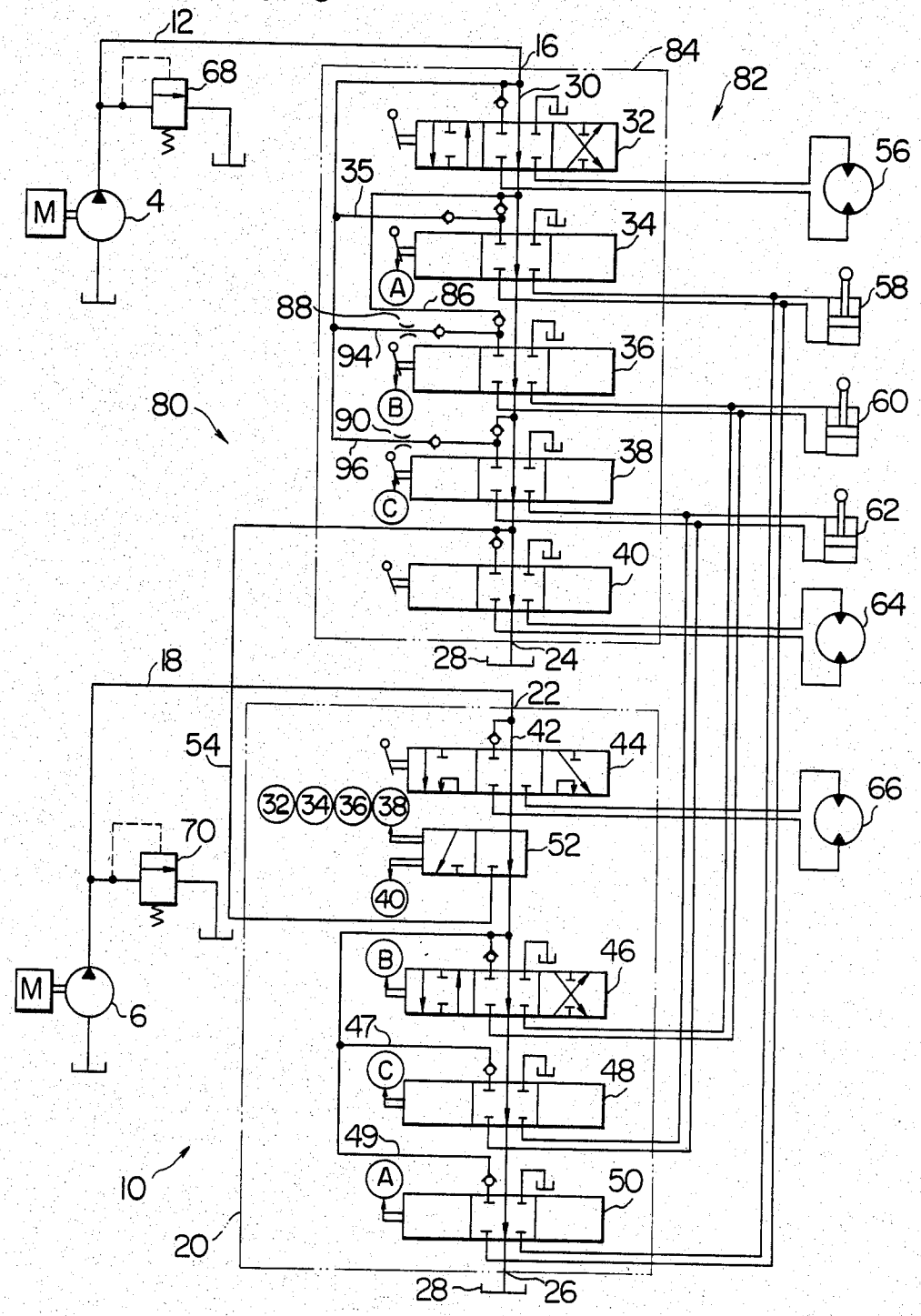
FIG. 3 is a circuit diagram of the hydraulic circuit system comprising a second embodiment.

As shown in FIG. 3, a hydraulic circuit system generally designated by the reference numeral 80 comprises a first hydraulic circuit generally designated by the reference numeral 82 similar to the first hydraulic circuit 8 of the first embodiment shown in FIG. 1 except that the valves of a first valve group 84 are distinct in connection from the valves of the first valve group 14.

The first valve group 84 comprises swing directional control valve 32, first boom directional control valve 34, first arm directional control valve 36, first bucket directional control valve 38 and left travel directional control valve 40 connected with one another in the indicated order from the upstream side of the center bypass line 30 to the downstream side thereof, with the swing valve 32 and the first boom valve 34 being connected in parallel with one another by the bypass line 35. The first boom valve 34 and first arm valve 36 are connected in parallel with each other through a bypass line 86, and the valve 36 is also connected in tandem with the valve 32. The first bucket valve 38 and left travel valve 40 are connected in tandem with the valves 32, 34 and 36. The valves 36 and 38 are subsidiarily connected to the bypass line 35 through bypass lines 94 and 96 mounting flow restrictors 88 and 90, respectively. The bypass lines 35, 94 and 96 are each provided with a check valve, as shown, as usual for preventing backflow of hydraulic fluid.

The restrictors 88 and 90 each have a capacity such that they are capable of holding hydraulic fluid at a sufficiently high pressure level to drive any one of the swing, boom, arm and bucket that requires the highest drive pressure or the drive pressure of the swing, for example.

Other parts of the hydraulic circuit system shown in FIG. 3 are similar to those of the hydraulic circuit system shown in FIG. 1.

Operation of the embodiment shown in FIG. 3 will now be described.

(1) Travelling Operation

In this operation, the left and right travel motors 64 and 66 are driven independently of each other in the same manner as described by referring to the embodiment shown in FIG. 1.

(2) Travelling Operation Combined with Operation of One of Other Actuators

The travelling operation can be performed simultaneously with and independently of the operation of any one of the other actuators and steering in either direction can be freely effected during operation of any one of the other actuators in the same manner as described by referring to the embodiment shown in FIG. 1.

(3) Travelling Operation Combined with Swing and Boom Operation

The travelling operation can be performed simultaneously with and independently of the swing and boom operations in the same manner as described by referring to the embodiment shown in FIG. 1.

(4) Swing Operation Combined with Boom, Arm or Bucket Operation

Combined operations of swing and boom can be performed in the same manner as described by referring to the embodiment shown in FIG. 1.

When combined operations of swing and arm or swing and bucket are performed, a portion of hydraulic fluid from the first pump 4 flows through the bypass line 94 or 96 to the arm cylinder 60 or bucket cylinder 62 through the first arm valve 36 or first bucket valve 38. The provision of the restrictor 88 or 90 enables the swing motor 56 to operate essentially independently of the arm cylinder 60 or bucket cylinder 62. Thus, the swing operation can be performed simultaneously with and essentially independently of the arm or bucket operation.

(5) Combined Operations of Swing, Boom, Arm and Bucket or Three of These

When combined operations of swing, boom, arm and bucket are performed, hydraulic fluid from the first pump 4 is supplied to the swing motor 56 and boom cylinder 58 through the swing valve 32 and first boom valve 34 while a portion of the hydraulic fluid flows to the arm cylinder 60 and bucket cylinder 62 through the bypass lines 94 and 96 mounting the restrictors 88 and 90 and through the first arm valve 36 and first bucket valve 38, respectively. Other operations are the same as those described by referring to the embodiment shown in FIG. 1. Thus, four operations of swing boom, arm and bucket can be performed simultaneously. Likewise, operations of any three these actuators can be performed simultaneously.

(6) Travelling Operations Combined with Operations of two of Other Actuators

Travelling operation combined with swing and boom operations has been described in paragraph (3).

When travelling operation combined with swing and arm operations is performed, hydraulic fluid from the first pump 4 is supplied to the swing motor 56 through the swing valve 32 and a portion thereof is supplied to the arm cylinder 60 through the bypass line 94 and through the first arm valve 36. Hydraulic fluid from the second pump 6 is supplied to the left and right travel valves 40 and 44 since the directional selecting valve 52 is in the second position. Thus, the travelling operation can be performed simultaneously with and independently of the swing and arm operations.

Likewise, travelling operation combined with swing and bucket operations, travelling operation combined with boom and bucket operations and travelling operation combined with arm and bucket operations can be performed simultaneously and independently by virtue of the provision of the bypass line 96.

Travelling operation combined with boom and arm operations can also be performed simultaneously and independently by virtue of the provision of the bypass line 86.

Accordingly, it will be understood that in the embodiment shown in FIG. 3, it is possible to perform operation of any two of the actuators while the machine is travelling, thereby enabling operability to be further improved.

With regard to the bypass line 86, when it is important to perform boom and arm operations independently of each other in performing combined operations thereof, one only has to manipulate, based on the same princple as described in paragraph (4) by referring to the embodiment shown in FIG. 1, the arm operation lever in two stages in such a manner that the second arm valve 46 is actuated in the first stage operation and the first arm valve 36 is actuated in the second stage operation.

Figure 4:
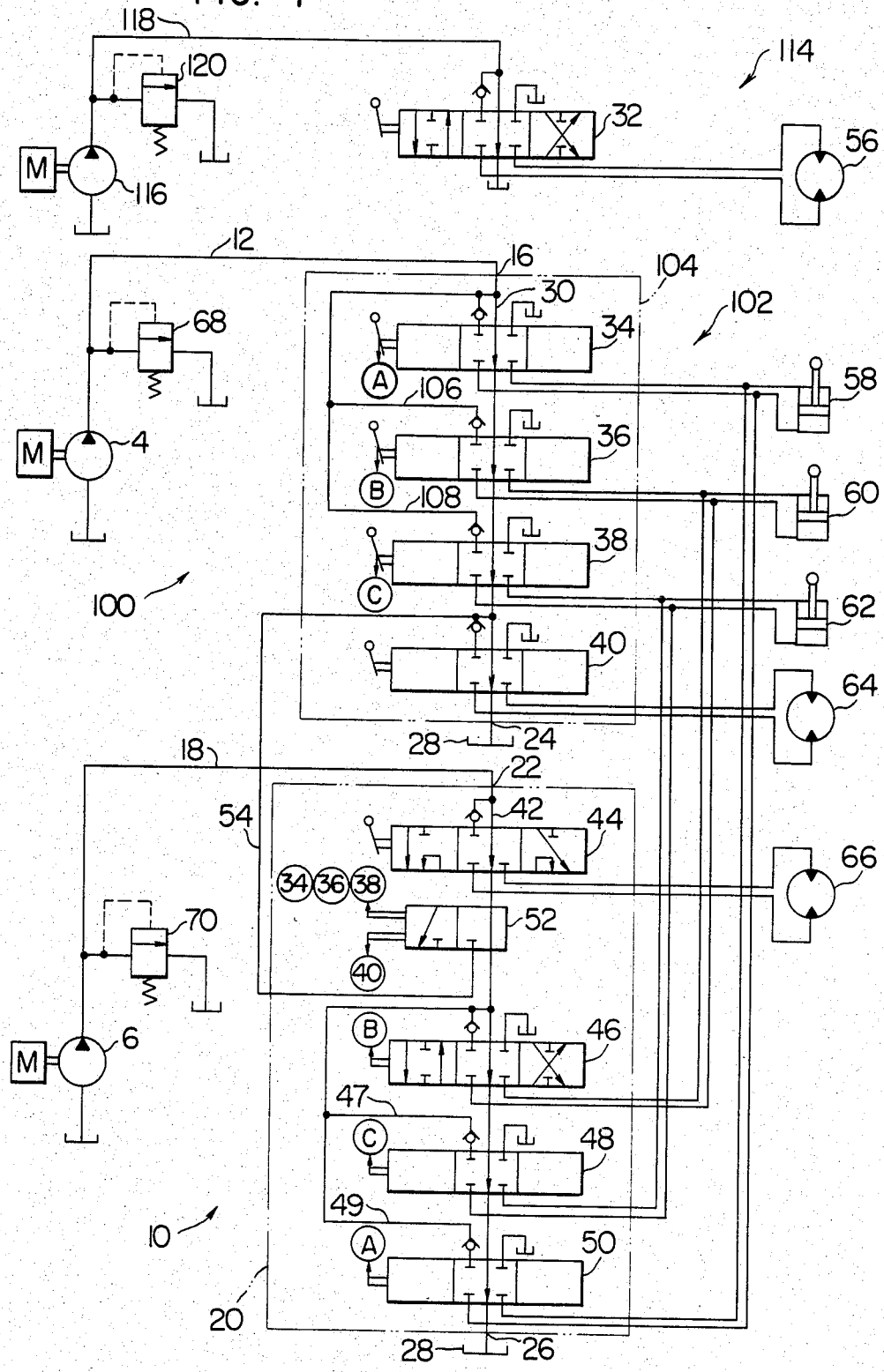
FIG. 4 is a circuit diagram of the hydraulic circuit system comprising a third embodiment.

As shown in FIG. 4, a hydraulic circuit system generally designated by the reference numeral 100 comprises a first hydraulic circuit generally designated by the reference numeral 102 which is distinct from the first hydraulic circuit 8 of the embodiment shown in FIG. 1 in the construction of a first valve group 104.

The first valve group 104 comprises first boom directional control valve 34, first arm directional control valve 36, first bucket directional control valve 38 and left travel directional control valve 40 connected with one another in the indicated order from the downstream side of the center bypass line 30 to the downstream side thereof. The first boom valve 34, first arm valve 36 and first bucket valve 38 are connected in parallel with one another through bypass lines 106 and 108 and are connected in tandem with the left travel valve 40. The bypass lines 106 and 108 are each provided with a check valve for preventing backflow of hydraulic fluid as shown.

Other parts of the first hydraulic circuit 102 and the construction of a second hydraulic circuit 10 are similar to those of the embodiment shown in FIG. 1, except that the directional selecting valve 52 is switched to the second position when the left travel valve 40 is actuated simultaneously with at least one of the first boom valve 34, first arm valve 36 and first bucket valve 38.

The hydraulic circuit 100 further comprises a third hydraulic circuit generally designated by the reference numberal 114 having a third hydraulic pump 116, the swing motor 56 driven by hydraulic fluid supplied from the third pump 116, and the swing directional control valve 32 for controlling the flow rate and direction of hydraulic fluid supplied from the third pump 116 to the swing motor 56. The third pump 116 is connected through a main line 118 to the swing valve 32. 120 is a relief valve. Thus, it will be noted that in the third hydraulic circuit 114, the third pump 116 is used exclusively for driving the swing motor 56.

Operation of the embodiment shown in FIG. 4 will be described.

(1) Travelling Operation

Like the embodiment shown in FIG. 1, the embodiment shown in FIG. 4 allows the left and right travel motors 64 and 66 to be driven independently of each other.

(2) Travelling Operation Combined with Operation of One of Other Actuators

When travelling operation combined with swing operation is performed, hydraulic fluid from the first pump 4 is supplied to the left travel motor 64 through the left travel valve 40, hydraulic fluid from the second pump 6 is supplied to the right travel motor 66 through the right travel valve 44 and hydraulic fluid from the third pump 116 is supplied to the swing motor 56 through the swing valve 32. Thus, the respective actuators can be driven simultaneously and independently.

When travelling operation combined with boom operation is performed, hydraulic fluid from the first pump 4 is supplied to the boom cylinder 58 through the first boom valve 34 and hydraulic fluid from the second pump 6 is supplied to the left and right travel motors 64 and 66 through the left and right travel valves 40 and 44, respectively, since the directional selecting valve 52 is switched to the second position. Thus, the travel motors and the boom cylinder can be driven simultaneously and independently. Likewise, the travel motors can be driven simultaneously with the arm cylinder or bucket cylinder in combination independently of each other.

(3) Travelling Operation Combined with Swing and Boom Operations

When travelling operation combined with swing and boom operations is performed, combined travelling and boom operations are performed with hydraulic fluid supplied from the first and second pumps 4 and 6 as described in paragraph (2), and the swing motor 56 separately receives a supply of hydraulic fluid from the third pump 116. Thus, the travelling, swing and boom operations can be performed simultaneously and independently.

(4) Swing Operation Combined with Boom, Arm or Bucket Operation

When swing operation combined with boom operation is performed, hyraulic fluid from the third pump 116 is supplied to the swing motor 56 through the swing valve 32 and hydraulic fluids from the first and second pumps 4 and 6 are supplied to the boom cylinder 58 through the first and second boom valves 34 and 50, respectively. Thus, swing operation and boom operation can be performed simultaneously and independently while allowing the boom operation to be performed at high speed. Likewise, swing operation and arm operation or bucket operation can be performed simultaneously and independently.

(5) Combined Operations of Swing, Boom, Arm and Bucket or Three of These

When combined operations of swing, boom, arm and bucket operations are performed, hydraulic fluids from the first and second pumps 4 and 6 are supplied to the boom cylinder 58, arm cylinder 60 and bucket cylinder 62 through bypass lines 106, 108, 47 and 49 and through the first and second boom valves 34 and 50, first and second arm valves 36 and 46 and first and second bucket valves 38 and 48, respectively. Hydraulic fluid from the third pump 116 is supplied to the swing motor 56 through the swing valve 32. Thus, the four operations can be performed simultaneously while allowing the swing operation to be performed independently. Likewise, operations of any three of swing, boom, arm and bucket actuators can be performed simultaneously.

(6) Travelling Operation Combined with Operations of Two of Other Actuators

Travelling operation combined with swing and boom operations has been described in paragraph (3) hereinabove.

Travelling operation combined with swing and arm operations or swing and bucket operations is essentially similar to travelling operation combined with swing and boom operations except that the boom operation of the latter is replaced by the arm operation or bucket operation. Thus, the travelling operation, swing operation and arm or bucket operation can be performed simultaneously and independently.

When travelling operation combined with boom and arm operations is performed, hydraulic fluid from the first pump 4 is supplied through the bypass line 106 to the boom cylinder 58 and arm cylinder 60 through the first boom valve 34 and first arm valve 36, respectively. Since the directional selecting valve 52 is in the second position at this time, hydraulic fluid from the second pump 6 is supplied to the left and right travel motors 64 and 66 through the left and right valves 40 and 44, respectively. Thus, the travelling operation can be performed simultaneously with and independently of the boom and arm operations. Likewise, travelling operation and boom and bucket operations or arm and bucket operations can be performed simultaneously and independently.

From the foregoing, it will be appreciated that in the hydraulic circuit system according to the invention, when travelling operation combined with an operation of any one of the other actuators is performed, hydraulic fluid from the first pump is preferentially supplied to the directional control valve for the one other actuator and hydraulic fluid from the second hydraulic pump is supplied to a second travel directional control valve and is returned to the circuit to be supplied to a first travel directional control valve through the directional selecting valve and the bypass line, so that the travelling operation and the operation of any one of the other actuators can be performed simultaneously and independently of each other. It will be also appreciated that when steering in either direction is conducted during travelling operation combined with an operation of one of the other actuators, hydraulic fluid from the second pump is positively supplied to the directional control valve for the travel motor requiring hydraulic fluid for steering either directly or through the directional selecting valve, so that the vehicle can be freely steered in either direction. Accordingly, it will be appreciated that it is possible to perform combined operations in a wide range while substantially ensuring independency of an operation of each actuator.

What is claimed is:

1. A hydraulic circuit system for a hydraulic excavator equipped with a swing, left and right traveling devices, a boom, an arm, and a bucket, said hydraulic circuit system including a swing actuator, connected to the swing for driving thereof, a first travel actuator connected to one of the left and right traveling devices for driving thereof, a second travel actuator connected to the other of the left and right traveling devices for driving thereof, a boom actuator connected to the boom for driving thereof, an arm actuator connected to the arm for driving thereof, and a bucket actuator connected to the bucket for driving thereof, said hydraulic circuit system comprising first hydraulic circuit means, second hydraulic circuit means and bypass circuit means connecting the first and second hydraulic circuit means together, said first hydraulic circuit means including a first hydraulic pump and a first valve group having a plurality of directional control valves for controlling a flow of hydraulic fluid from said first hydraulic pump, and said second hydraulic circuit means including a second hydraulic pump and a second valve group having a plurality of directional control valves for controlling a flow of hydraulic fluid from said second hydraulic pump, said directional control valves of said first and second valve groups being connected to the associated actuators for driving thereof by the hydraulic fluid supplied from the first and second pumps through the directional control valves, wherein said directional control valves of said first valve group in said first hydraulic circuit means include a first travel directional control valve connected to said first travel actuator for controlling a flow of hydraulic fluid to the first travel actuator, said first travel directional control valve being connected in tandem with the other valves of the first valve group in a position downstream thereof so that the other directional control valves of the first valve group can take priority in receiving a supply of hydraulic fluid from said first hydraulic pump;

said directional control valves of said second valve group in said second hydraulic circuit means include a second travel directional control valve connected to said second travel actuator for controlling a flow of hydraulic fluid to the second travel actuator, said second travel directional control valve being connected in series with the other valves of the second valve group in a position upstream thereof through a directional selecting valve so that said second travel directional control valve can directly receive a supply of hydraulic fluid from said second hydraulic pump and supply the same to said second travel actuator or said bypass circuit means and permits the used hydraulic fluid from the second travel actuator to return to the second hydraulic circuit means via said bypass circuit means for reuse;

said bypass circuit means includes a first bypass line for connecting the upstream side of said first travel directional control valve in series with said second travel directional control valve at a position downstream thereof through said directional selecting valve; and said directional selecting valve having first and second positions, said directional selecting valve normally taking the first position to communicate said second travel directional control valve with the other valves of said second valve group and permit the used and returned hydraulic fluid from said second travel directional control valve to be supplied to the other valves before returning to a reservoir, said directional selecting valve being switched to the second position, when said first travel directional control valve and at least one of the other valves of said first valve group are simultaneously actuated, to communicate said second travel directional control valve with said first travel directional control valve through said first bypass line and permit the used and returned hydraulic fluid from said second travel directional control valve to be supplied to said first travel directional control valve before returning to a reservoir.

2. A hydraulic circuit system as claimed in claim 1, wherein the other valves of said first valve group in said first hydraulic circuit means include a swing directional control valve connected to said swing actuator for controlling a flow of hydraulic fluid to the swing actuator, and a first boom directional control valve connected to said boom actuator for controlling a flow of hydraulic fluid to the boom actuator, said swing directional control valve and said first boom directional control valve being connected in parallel with each other through a second bypass line.

3. A hydraulic circuit system as claimed in claim 2, wherein the other valves of said first valve group in said first hydraulic circuit means further include a first arm directional control valve connected to said arm actuator for controlling a flow of hydraulic fluid to the arm actuator and connected in tandem with said first boom directional control valve in a position downstream thereof, and the other valves of said second valve group in said second hydraulic circuit means include a second arm directional control valve connected to said arm actuator for controlling a flow of hydraulic fluid to said arm actuator, and a bucket directional control valve connected to said bucket actuator for controlling a flow of hydraulic fluid to the bucket actuator, said second arm directional control valve and said bucket directional control valve being connected in parallel with each other through a third bypass line.

4. A hydraulic circuit system as claimed in claim 1, wherein the other valves of said first valve group in said first hydraulic circuit system are connected in parallel with one another through respective bypass lines.

5. A hydraulic circuit system as claimed in claim 1, wherein the other valves of said first valve group in said first hydraulic circuit means include a swing directional control valve connected to said swing actuator for controlling a flow of hydraulic fluid to the swing actuator, a boom directional control valve for controlling a flow of hydraulic fluid to the boom actuator, and an arm directional control valve connected to said arm actuator for controlling a flow of hydraulic fluid to the arm actuator, said boom directional control valve being connected in parallel with said swing directional control valve through a fourth bypass line, and said arm directional control valve being connected in parallel with said boom directional control valve through a fifth bypass line in a position downstream of said swing directional control valve.

6. A hydraulic circuit system as claimed in claim 5, wherein said arm directional control valve is subsidiarily connected to said fourth bypass line through a sixth bypass line mounting a flow restrictor.

7. A hydraulic circuit system as claimed in claim 5, wherein the other valves of said first valve group in said first hydraulic circuit means further include a bucket directional control valve connected to said bucket actuator for controlling a flow of hydraulic fluid to the bucket actuator, said bucket directional control valve being connected in tandem with said swing, boom and arm directional control valves in a position downstream thereof and being subsidiarily connected to said fourth bypass line through a seventh bypass line mounting a flow restrictor.

8. A hydraulic circuit system as claimed in claim 1, further comprising a third hydraulic circuit means including a third hydraulic pump, said swing actuator being driven by hydraulic fluid from said third hydraulic pump, and a swing directional control valve connected to said swing actuator for controlling a flow of hydraulic fluid supplied from said third hydraulic pump to said swing actuator, and the other valves of said first valve group in said first hydraulic circuit means including a boom direction control valve connected to said boom actuator for controlling a flow of hydraulic fluid to the boom actuator.

9. A hydraulic circuit system as claimed in claim 8, wherein the other valves of said first valve group in said first hydraulic circuit means further include an arm directional control valve connected to said arm actuator for controlling a flow of hydraulic fluid to the arm actuator, said arm directional control valve being connected in parallel with said boom directional control valve through an eighth bypass line, and the other valves of said second valve group in said second hydraulic means include a bucket directional control valve connected to said bucket actuator for controlling a flow of hydraulic fluid to the bucket actuator.

10. A hydraulic circuit system as claimed in claim 8 wherein the other valves of said first valve group in said first hydraulic circuit means further include a bucket directional control valve connected to said bucket actuator for controlling a flow of hydraulic fluid to the bucket actuator, said bucket directional control valve being connected in parallel with said boom directional valve through a ninth bypass line, and the other valves of said second valve group in said second hydraulic circuit means include an arm directional control valve connected to said arm actuator for controlling a flow of hydraulic fluid to the arm actuator.

11. A hydraulic circuit system for a hydraulic excavator equipped with a swing, left and right traveling devices, a boom, an arm, and a bucket, said hydraulic circuit system including a swing actuator connected to the swing for driving thereof, a first travel actuator connected to one of the left and right traveling devices for driving thereof, a second travel actuator connected to the other of the left and right traveling devices for driving thereof, a boom actuator connected to the boom for driving thereof, an arm actuator connected to the arm for driving thereof, and a bucket actuator connected to the bucket for driving thereof, said hydraulic circuit system;

comprising first hydraulic circuit means, second hydraulic circuit means, and bypass circuit means connecting the first and second hydraulic circuit means together, said first hydraulic circuit means including a first hydraulic pump and a first valve group having a plurality of directional control valves for controlling a flow of hydraulic fluid from said first hydraulic pump, and said second hydraulic circuit means including a second hydraulic pump and a second valve group having a plurality of directional control valves for controlling a flow of hydraulic fluid from said second hydraulic pump, said directional control valves of said first and second valve groups being connected to the associated actuators for driving thereof by the hydraulic fluid supplied from the first and second hydraulic pumps through the directional control valves, wherein said directional control valves of said first valve group in said first hydraulic circuit means include a first travel directional control valve connected to said first travel actuator for controlling a flow of hydraulic fluid to the first travel actuator, said first travel directional control valve being connected in tandem with other valves of the first valve group in a position downstream thereof so that the other directional control valves of the first valve group can take priority in receiving a supply of hydraulic fluid from said first hydraulic pump;

said directional control valves of said second valve group in said second hydraulic circuit means include a second travel directional control valve connected to said second travel actuator for controlling a flow of hydraulic fluid to the second travel actuator, said second travel directional control valve having a center-bypass line connected to said second pump for allowing a supply of hydraulic fluid therefrom to be passed through the center-bypass line to the downstream side of the valve when the valve is in a neutral position and being constructed such that when the second travel directional control valve is in an operative position, said center-bypass line is blocked and a return line from said second travel actuator for returning a hydraulic fluid used therein is connected to the center-bypass line on the downstream side of the valve;

a directional selecting valve being connected to said center-bypass line on the downstream side of said second travel directional control valve thereby to be connected in series thereto so as to receive fluid from said second travel directional control valve when same is in a neutral position and to receive a used hydraulic fluid from the second travel actuator when said second travel directional control valve is in the operative position, the other valves of said second valve group other than said second travel directional control valve being connected to said center-bypass line on the downstream side of said directional selecting valve;

said bypass circuit means including a first bypass line connecting the upstream side of said first travel directional control valve to said directional selecting valve on the downstream side thereof;

said directional selecting valve having a first position in which said center-bypass line is opened to establish a series connection between the second travel directional control valve and the other valves of the second valve group, and a second position in which said center-bypass line is blocked and said first bypass line is connected to the center-bypass line to establish a series connection between the second and first travel directional control valves, said directional selecting valve normally taking the first position and being switched to the second position when said first travel directional control valve and at least one of the other valves of said first valve group are simultaneously actuated, thereby allowing a fresh hydraulic fluid from said second pump to be supplied to the first travel directional control valve when the second travel direction control valve is in the neutral position and the used hydraulic fluid from the second travel actuator to be supplied to the first travel directional control valve when the second travel direction control valve is in the operative position.

* * * * *